US009016890B2

(12) United States Patent
Kim et al.

(10) Patent No.: US 9,016,890 B2
(45) Date of Patent: Apr. 28, 2015

(54) OPTICAL SEMICONDUCTOR-BASED TUBE TYPE LIGHTING APPARATUS

(75) Inventors: Kyung Rye Kim, Seongnam-si (KR); Jae Young Choi, Seongnam-si (KR); Kyoung Onn Kim, Seongnam-si (KR)

(73) Assignee: Posco LED Company Ltd., Seongnam-si (KR)

( * ) Notice: Subject to any disclaimer, the term of this patent is extended or adjusted under 35 U.S.C. 154(b) by 0 days.

(21) Appl. No.: 13/590,927

(22) Filed: Aug. 21, 2012

(65) Prior Publication Data

US 2012/0320571 A1 Dec. 20, 2012

Related U.S. Application Data

(62) Division of application No. 13/296,122, filed on Nov. 14, 2011.

(30) Foreign Application Priority Data

May 23, 2011 (KR) ..... 10-2011-0048652
Aug. 8, 2011 (KR) ..... 10-2011-0078701

(51) Int. Cl.

| | |
|---|---|
| ***F21V 29/00*** | (2006.01) |
| ***F21K 99/00*** | (2010.01) |
| ***F21V 3/00*** | (2006.01) |
| ***F21V 19/00*** | (2006.01) |

(Continued)

(52) U.S. Cl.

CPC ... *F21K 9/17* (2013.01); *F21V 3/00* (2013.01); *F21V 19/0045* (2013.01); *F21Y 2111/002* (2013.01); *F21V 29/22* (2013.01); *F21Y 2101/02* (2013.01); *F21K 9/90* (2013.01); *F21V 21/005* (2013.01)

(58) Field of Classification Search

USPC ..... 313/506; 362/218, 235, 240

See application file for complete search history.

(56) References Cited

U.S. PATENT DOCUMENTS 6,409,361 B1 6/2002 Ikeda
7,350,952 B2 * 4/2008 Nishigaki ..... 362/602

(Continued)

FOREIGN PATENT DOCUMENTS

JP 2000-268604 9/2000
JP 3134432 8/2007

(Continued)

OTHER PUBLICATIONS

International Search Report for PCT Application No. PCT/KR2011/008644 dated Feb. 21, 2012.

(Continued)

*Primary Examiner* — Mariceli Santiago
*Assistant Examiner* — Brenitra M Lee
(74) *Attorney, Agent, or Firm* — H.C. Park & Associates, PLC

(57) ABSTRACT

An optical semiconductor-based tube type lighting apparatus capable of enlarging light distribution to have improved assembly characteristics. The lighting apparatus includes an elongated light-transmitting tube, and a plurality of optical semiconductor modules arranged along a circumference of the light-transmitting tube and separated from each other in a cross-sectional view of the light-transmitting tube. Each of the optical semiconductor modules is placed on a point, which is not on a central axis line of light emitted from other optical semiconductor modules, so as not to face another optical semiconductor module at an opposite side thereof.

13 Claims, 8 Drawing Sheets

(51) Int. Cl.

| | |
|---|---|
| ***F21V 21/005*** | (2006.01) |
| *F21Y 111/00* | (2006.01) |
| *F21Y 101/02* | (2006.01) |

(56) References Cited

U.S. PATENT DOCUMENTS

| | | | | |
|---|---|---|---|---|
| 2009/0161359 | A1* | 6/2009 | Siemiet et al. | 362/235 |
| 2009/0290334 | A1 | 11/2009 | Ivey et al. | |
| 2010/0177532 | A1* | 7/2010 | Simon et al. | 362/555 |
| 2011/0006688 | A1 | 1/2011 | Shim | |
| 2012/0212950 | A1 | 8/2012 | Wei | |

FOREIGN PATENT DOCUMENTS

| | | |
|---|---|---|
| JP | 3145174 | 9/2008 |
| JP | 2009-105354 | 5/2009 |
| JP | 3151501 | 6/2009 |
| JP | 2009-170186 | 7/2009 |
| JP | 2010-198927 | 9/2010 |
| JP | 3164747 | 11/2010 |
| JP | 3165829 | 1/2011 |
| JP | 2011-44306 | 3/2011 |
| JP | 2011-044306 | 3/2011 |
| JP | 2011-508380 | 3/2011 |
| JP | 2011-513913 | 4/2011 |
| JP | 2011-096614 | 5/2011 |
| JP | 2011-1138976 | 6/2011 |
| KR | 10-091840 | 9/2009 |
| KR | 10-2010-0012952 | 2/2010 |
| KR | 10-2010-0124531 | 11/2010 |
| KR | 20-2010-0011126 | 11/2010 |
| KR | 10-2010-0126064 | 12/2010 |
| KR | 10-2011-0015716 | 2/2011 |
| KR | 10-2011-0021096 | 3/2011 |
| WO | 2009/085500 | 7/2009 |

OTHER PUBLICATIONS

Written Opinion for PCT Application No. PCT/KR2011/008644 dated Feb. 21, 2012.

Non-Final Office Action issued to U.S. Appl. No. 13/590,943 dated May 1, 2013.

Non-Final Office Action dated Oct. 11, 2013 in U.S. Appl. No. 13/296,122.

Final Office Action issued on Apr. 15, 2014 in U.S. Appl. No. 13/296,122.

Non-Final Office Action issued on Oct. 10, 2014 in U.S. Appl. No. 14/080,258.

Non-Final Office Action issued on Sep. 25, 2014 in U.S. Appl. No. 13/296,122.

* cited by examiner

OPTICAL SEMICONDUCTOR-BASED TUBE TYPE LIGHTING APPARATUS

CROSS-REFERENCE TO RELATED APPLICATIONS

This application is a divisional of U.S. patent application Ser. No. 13/296,122, filed on Nov. 14, 2011, and claims priority from and the benefit of Korean Patent Application No. 10-2011-0048652, filed on May 23, 2011, and No. 10-2011-0078701, filed on Aug. 8, 2011, all of which are hereby incorporated by reference for all purposes as if fully set forth herein.

BACKGROUND OF THE INVENTION

1. Field of the Invention

The present invention relates to optical semiconductor-based tube type lighting apparatuses.

2. Discussion of the Background

Generally, fluorescent lamps and incandescent lamps are used as a light source for lighting. Incandescent lamps have low economic feasibility due to high power consumption and thus demand for incandescent lamps continues to decrease. Further, it is predicted that this trend will continue into the future. On the contrary, fluorescent lamps have higher economic feasibility due to low power consumption, which is about ⅓ that of incandescent lamps. However, fluorescent lamps require application of high voltage, causing a blackening phenomenon and shortening the lifespan thereof. Further, mercury injected together with argon gas into a vacuum glass tube of a fluorescent lamp is toxic and environmentally unfriendly.

Recently, demand for LED lighting apparatuses employing an LED as a light source has rapidly increased. The LED lighting apparatus has long lifespan and requires low power for operation. Further, the LED lighting apparatus does not use a toxic substance such as mercury, thereby guaranteeing environmental friendliness.

Various kinds of LED lighting apparatuses having various structures have been developed. For example, a fluorescent lamp type or tube type LED lighting apparatus has a similar configuration to that of a fluorescent lamp.

FIG. 1 is a cross-sectional view of a conventional tube type LED lighting apparatus.

Referring to FIG. 1, the conventional tube type LED lighting apparatus includes an elongated light-transmitting cover 2 having a substantially semi-circular cross-section and open at an upper side thereof, and an elongated LED module 4 coupled to the open upper side of the light-transmitting cover. The LED module 4 includes an elongated heat sink 4*a* having a substantially semi-circular cross-section, a long printed circuit board (PCB) 4*b* attached to a flat surface of the heat sink 4*a*, and LEDs 4*c* arranged on the PCB 4*b* in a longitudinal direction. The LEDs 4*c* inside the LED module 4 emit light to the front of the lighting apparatus, that is, in a downward direction.

The conventional LED lighting apparatus emits light through an arcuate area in a predetermined angle range (in the range of about 120~150 degrees) at a lower portion of the light-transmitting plastic cover 2. Further, since the back of the conventional tube type LED lighting apparatus is completely blocked by the heat sink 4*a*, light is not distributed to rear and lateral sides of the light-transmitting cover 2.

Such a conventional tube type LED lighting apparatus has very unsatisfactory light distribution characteristics as compared with existing fluorescent lamps. Accordingly, when the conventional tube type LED lighting apparatus is used in homes or offices instead of the existing fluorescent lamps, dark areas are generated at the rear and lateral sides of the lighting apparatus. Such dark areas cause user dissatisfaction as light coverage is uneven.

Such a conventional tube type LED lighting apparatus is configured to allow light to be diffusively emitted only through the semi-circular light-transmitting cover 2 and thus has lower light distribution characteristics than existing fluorescent lamps, which employ a light-transmitting tube. In addition, in the conventional tube type LED lighting apparatus, the LED 4*c* or the LED module including the LED 4*c* is located at the center of a tube-shaped cross-section defined by an outer periphery of the light-transmitting cover 2 and an outer periphery of the heat sink, thereby causing a short distance between a light emitting plane of the LED 4*c* and the light-transmitting cover 2 on a predetermined cross-sectional area of the tube type LED lighting apparatus. Since an area of the light-transmitting cover 2 through which light from the LED 4*c* passes decreases with decreasing distance between the light emitting plane of the LED 4*c* and the light-transmitting cover 2, the conventional tube type LED lighting apparatus has unsatisfactory light distribution characteristics towards the lateral and rear sides thereof.

SUMMARY OF THE INVENTION

An exemplary embodiment of the invention provides a tube type optical semiconductor-based lighting apparatus which includes a bar-shaped optical semiconductor module directly mounted on a wall of a light-transmitting tube to increase a distance between a semiconductor optical device and the light-transmitting tube in order to improve light distribution.

Other exemplary embodiments of the invention provide an optical semiconductor-based lighting apparatus and a method of manufacturing the same, which has improved assembling properties when directly mounting a bar-shaped optical semiconductor module to a wall of a light-transmitting tube such that the optical semiconductor module is partially exposed from the light-transmitting tube.

Additional features of the invention will be set forth in the description which follows, and in part will be apparent from the description, or may be learned by practice of the invention.

An exemplary embodiment of the invention provides an optical semiconductor-based tube type lighting apparatus, which includes an elongated light-transmitting tube; and a plurality of optical semiconductor modules arranged along a circumference of the light-transmitting tube and separated from each other in a cross-sectional view of the light-transmitting tube. Here, each of the optical semiconductor modules is placed on a point, which is not on a central axis line of light emitted from other optical semiconductor modules, so as not to face the other optical semiconductor modules. Further, the plurality of optical semiconductor modules may include a first optical semiconductor module placed at an upper portion of the light-transmitting tube such that an angle defined between a tangential line to the light-transmitting tube and the central axis line of light becomes 90 degrees, and emitting light downwards beneath the light-transmitting tube, and second and third optical semiconductor modules slantly placed at opposite lower sides of the light-transmitting tube so as not to face the first optical semiconductor module and emitting light upwards.

The plural optical semiconductor modules may be arranged at equal intervals.

The first, second and third optical semiconductor modules may be placed at three vertices of a single isosceles or equilateral triangle, respectively.

Each of the optical semiconductor modules may include an array of semiconductor optical devices arranged in a longitudinal direction of the light-transmitting tube.

The light-transmitting tube may include at least three slit pieces separated from one another, and each of the optical semiconductor modules may be assembled to a mounting gap between adjacent slit pieces.

Each of the optical semiconductor modules may include a base exposed through the mounting gap, a printed circuit board (PCB) coupled to the base and placed within the light-transmitting tube, and an array of semiconductor optical devices mounted on the PCB.

The light-transmitting tube may include a light spreading material on a surface thereof or therein.

The light-transmitting tube may include a wavelength converting material on a surface thereof or therein.

The first optical semiconductor module may have a light output, which is higher than those of the second and third optical semiconductor modules and is the same as the sum of those of the second and third optical semiconductor modules.

The second and third optical semiconductor modules may have different color temperatures from the color temperature of the first optical semiconductor module.

When the optical semiconductor-based tube type lighting apparatus is mounted on a ceiling, the first optical semiconductor module may be placed on a region of the light-transmitting tube nearer to the ceiling than any other region thereof.

The light-transmitting tube may have a hollow circular cross-section, and the plurality of optical semiconductor modules may be three optical semiconductor modules arranged at equal intervals of 120 degrees.

The light-transmitting tube may include three slit pieces having an arcuate cross-section and separated from each other, and each of the three optical semiconductor modules may be assembled to a mounting gap between adjacent slit pieces.

The optical semiconductor-based tube type lighting apparatus may further include a pair of connectors disposed at opposite ends of the light-transmitting tube, wherein at least one of the pair of connectors is a dummy connector which does not act as an electrical connector.

The base may be formed at opposite sides thereof with connection grooves corresponding to edges of each of the slit pieces such that the edges of each of the slit pieces are respectively fitted into the connection grooves.

The optical semiconductor modules may be mounted at an equal angle as defined between the tangential line to the light-transmitting tube and the central axis line of light.

An exemplary embodiment of the invention provides an optical semiconductor-based tube type lighting apparatus. The optical semiconductor-based tube type lighting apparatus includes: an elongated light-transmitting tube; a linear slit formed on the light-transmitting tube in a longitudinal direction thereof; and at least one bar-shaped optical semiconductor module secured to the light-transmitting tube, with edges of the slit fitted into side surfaces of the bar-shaped optical semiconductor module. Here, the optical semiconductor module includes a heat sink, a PCB attached to the heat sink, and an array of semiconductor optical devices arranged on the PCB. The heat sink is partially exposed from the light-transmitting tube through the slit.

The light-transmitting tube may include a pair of hooks formed on an inner periphery thereof in the longitudinal direction of the light transmitting tube to face each other, the slit may be formed in a middle between the pair of hooks in the longitudinal direction of the light transmitting tube, and right and left protrusions of the optical semiconductor module may be respectively inserted into the pair of hooks in a sliding manner when the slit is widened by external force.

When the slit is widened by external force, a heat dissipation protrusion at a rear side of the heat sink may be inserted into the slit in a sliding manner and exposed from the light-transmitting tube.

The heat sink may be provided with right and left guide wings, and the right and left guide wings and right and left edges of the PCB may be inserted into the corresponding hooks to form the right and left protrusions of the optical semiconductor module, respectively.

The PCB may be a metal-based MCPCB or MPCB.

In the light-transmitting tube, each of the optical semiconductor modules may be disposed so as not to face another optical semiconductor module at an opposite side thereof.

A further exemplary embodiment of the invention provides a method of manufacturing a semiconductor-based tube type lighting apparatus, which includes: preparing an elongated light-transmitting tube; forming a linear slit on the light-transmitting tube in a longitudinal direction of the light-transmitting tube; and assembling at least one optical semiconductor module to the light-transmitting tube by widening the slit and inserting the at least one optical semiconductor module into the widened slit in a sliding manner.

The light-transmitting tube may include a pair of hooks formed on an inner periphery of the light-transmitting tube to face each other in a longitudinal direction.

The assembling at least one optical semiconductor module may include inserting right and left protrusions formed at opposite sides of the optical semiconductor module into the respective hooks in a sliding manner, and inserting a protrusion formed at a rear side of the optical semiconductor module into the widened slit in a sliding manner to be exposed from the light-transmitting tube.

The forming a linear slit may include forming the slit over the entire length of the light-transmitting tube, and the assembling at least one optical semiconductor module may include widening the slit over the entire length of the light-transmitting tube and inserting the optical semiconductor module into the slit.

The forming a linear slit may include forming the slit on the light emitting tube except for a portion near one end of the light-transmitting tube, and the assembling at least one optical semiconductor module may include widening the slit only in a partial length region of the light-transmitting tube and inserting the optical semiconductor module into the widened slit.

Here, the method may further include removing the portion of the light-transmitting tube where the slit is not formed, after assembling the at least one optical semiconductor module.

Herein, the term "semiconductor optical device" refers to a device including or using an optical semiconductor such as a light emitting diode chip. Advantageously, the semiconductor optical device is an LED package including a light emitting diode chip therein.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
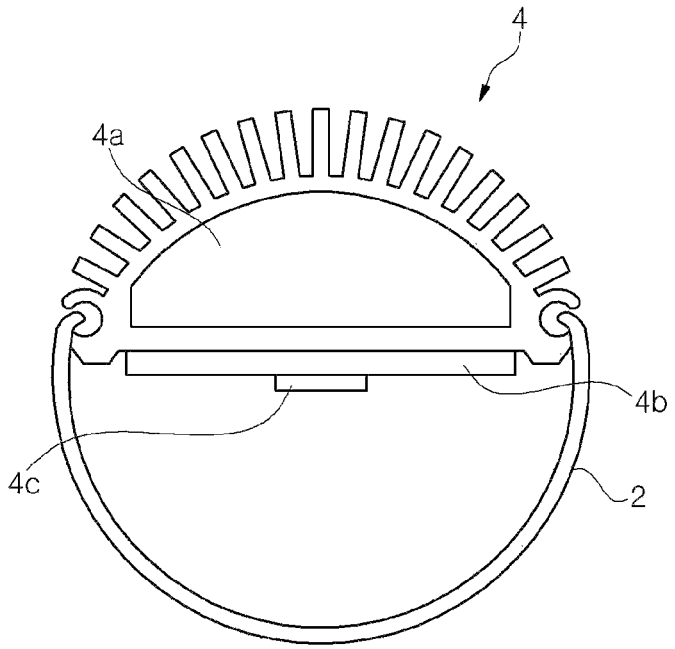
FIG. 1 is a cross-sectional view of an LED lighting apparatus, which is a conventional semiconductor-based lighting apparatus.

The invention is described more fully hereinafter with reference to the accompanying drawings, in which exemplary embodiments of the invention are shown. This invention may, however, be embodied in many different forms and should not be construed as limited to the embodiments set forth herein. Rather, these exemplary embodiments are provided so that this disclosure is thorough, and will fully convey the scope of the invention to those skilled in the art. In the drawings, the sizes and relative sizes of layers and regions may be exaggerated for clarity. Like elements will be denoted by like reference numerals and repeated descriptions thereof will be omitted herein.

Figure 2:
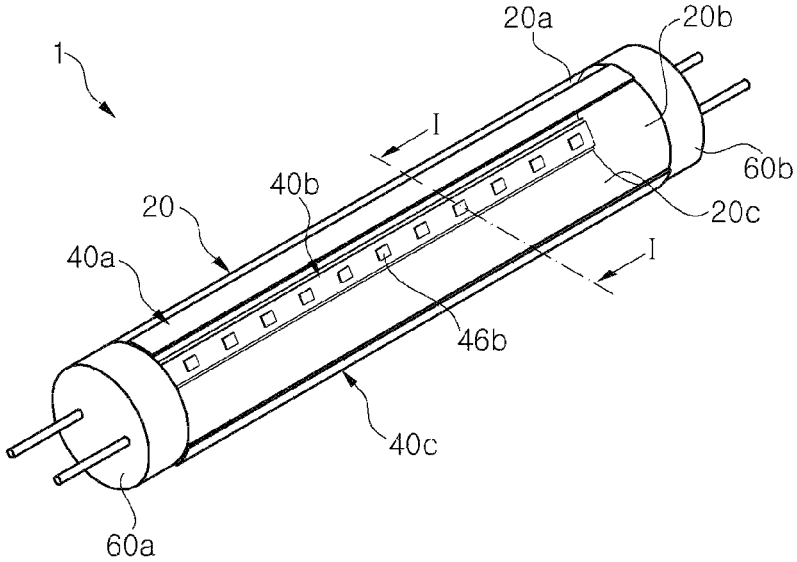
FIG. 2 is a perspective view of an optical semiconductor-based tube type lighting apparatus in accordance with one exemplary embodiment of the invention.
Figure 3:
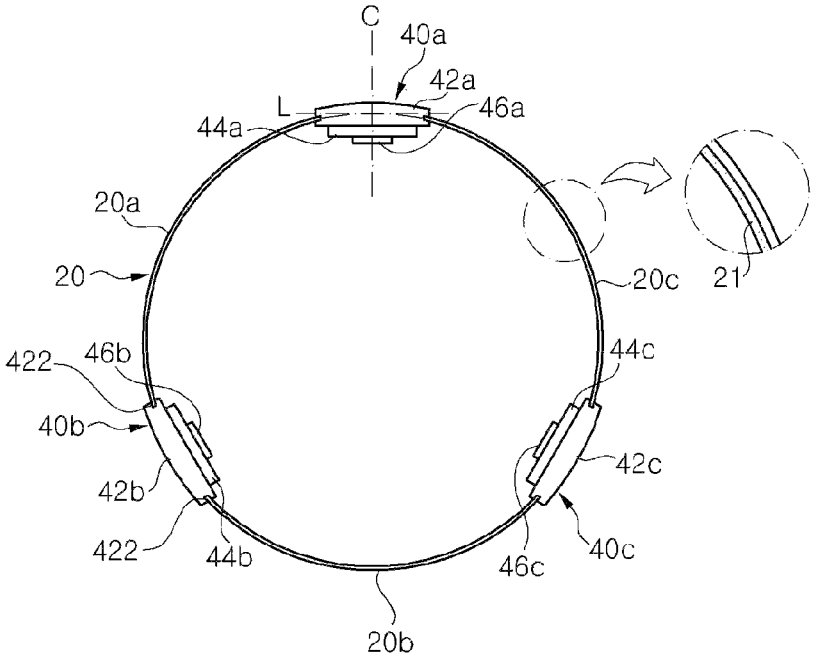
FIG. 3 is a cross-sectional view taken along line I-I of FIG. 2.

FIG. 2 is a perspective view of an optical semiconductor-based tube type lighting apparatus in accordance with one exemplary embodiment of the invention, and FIG. 3 is a cross-sectional view taken along line I-I of FIG. 2.

Referring to FIG. 2 and FIG. 3, the optical semiconductor-based tube type lighting apparatus 1 according to the exemplary embodiment of the invention is similar to a fluorescent lamp. The optical semiconductor-based tube type lighting apparatus 1 includes an elongated hollow light-transmitting tube 20 having a circular cross-section, and three optical semiconductor modules 40*a*, 40*b*, 40*c* arranged along a circumference of the light-transmitting tube 20.

In this embodiment, the light-transmitting tube 20 includes three elongated slit pieces 20*a*, 20*b*, 20*c*. Each of the slit pieces 20*a*, 20*b*, 20*c* is made of a light-transmitting plastic material exhibiting good impact resistance. Further, all of the slit pieces 20*a*, 20*b*, 20*c* have the same arcuate cross-section. When the three slit pieces 20*a*, 20*b*, 20*c* are arranged to form a circular cross-section, three elongated mounting gaps are formed between the slit pieces 20*a*, 20*b*, 20*c*.

The three bar-shaped optical semiconductor modules 40*a*, 40*b*, 40*c* are mounted to the three mounting gaps, respectively. As a result, the three optical semiconductor module 40*a*, 40*b*, 40*c* are placed at equal intervals of about 120 degrees along the circular circumference of the light-transmitting tube 20. Accordingly, the three optical semiconductor modules 40*a*, 40*b*, 40*c* are placed at three vertices of an imaginary equilateral triangle.

The light-transmitting tube 20 is provided at opposite sides thereof with two connectors 60*a*, 60*b*. Both of the connectors 60*a*, 60*b* may serve as electrical connectors for supplying power to the optical semiconductor modules 40*a*, 40*b*, 40*c*. Alternatively, only one of the connectors 60*a*, 60*b*, for example, a connector 60*a*, may serve as an electrical connector for supplying power to the optical semiconductor modules 40*a*, 40*b*, 40*c*. In this case, the other connector 60*b* may serve only as a mechanical connector for connecting one end of the light-transmitting tube 20 to one end of the connector. Furthermore, both of the connectors 60*a*, 60*b* may serve as mechanical connectors instead of electrical connectors. In this case, a separate electrical connector, which does not provide a function of a mechanical connector, may be provided to the light-transmitting tube 20 through an opening of the light-transmitting tube 20 together with a cable.

Herein, the connector which does not provide a function of an electrical connector and serves only as a mechanical connector will be defined as a "dummy connector".

The three optical semiconductor modules 40*a*, 40*b*, 40*c* may be mounted at an equal mounting angle on the light-transmitting tube 20. The mounting angle is defined as an angle between a tangential line L on the light-transmitting tube 20 at a mounting position of the corresponding optical semiconductor module and a central axis line C of light emitted from the corresponding optical semiconductor module. In this embodiment, the mounting angle is 90 degrees. In this embodiment, since the light-transmitting tube 20 has an arcuate or curved surface at the mounting position of the optical semiconductor module 40*a*, 40*b* or 40*c*, the angle between the tangential line L and the central axis line C is defined as the mounting angle. However, in the case where the light-transmitting tube has a linear surface at the mounting position of the optical semiconductor module, an angle between the linear surface and the central axis line of light emitted from the optical semiconductor module may be defined as the mounting angle. When the mounting angles of the optical semiconductor modules differ, design conditions are complicated, thereby making difficult to obtain a desired lighting apparatus with desired light distribution characteristics. Further, when the mounting angles differ, there is a possibility of light distribution being biased towards one side in a bisymmetrical light-transmitting tube 20. Therefore, the optical semiconductor modules 40*a*, 40*b*, 40*c* may be secured at an equal mounting angle to the light-transmitting tube 20 under different conditions in order to achieve desired light distribution.

As clearly shown in FIG. 3, each of the optical semiconductor modules 40*a*, 40*b* or 40*c* includes an elongated bar-shaped metal base 42*a*, 42*b* or 42*c* including a heat sink or acting as a heat sink, a PCB 44*a*, 44*b* or 44*c* mounted on the base 42*a*, 42*b* or 42*c*, and at least one array of semiconductor optical devices 46*a*, 46*b* or 46*c* mounted on the PCB 44*a*, 44*b* or 44*c*. On the PCB 44*a*, 44*b* or 44*c*, the semiconductor optical devices are arranged in at least one row to constitute the at least one array of semiconductor optical devices. The semiconductor optical devices 46*a*, 46*b* or 46*c* may be LED packages including a light emitting diode chip received therein, and may further include a wavelength converting material, which converts light emitted from the light emitting diode chip. However, the semiconductor optical device may be another optical semiconductor chip or device including or using the optical semiconductor chip, instead of the light emitting diode chip. Each of the metal bases 42*a*, 42*b* or 42*c* is partially exposed from the light-transmitting tube 20 through the mounting gap described above.

Each of the bases 42*a*, 42*b* or 42*c* of the optical semiconductor module 40*a*, 40*b* or 40*c* may be used to connect two adjacent slit pieces (20*a* and 20*b*; 20 and 20*c*; or 20*c* and 20*a*) to each other. In this embodiment, each of the bases 42*a*, 42*b* or 42*c* is formed at opposite sides thereof with connection grooves 422 each corresponding to a slit edge of the slit piece 20*a*, 20*b* or 20*c*, and the edges of the slit piece 20*a*, 20*b* or 20*c*, that is, opposite edges of the corresponding slit (or, cut surfaces), are fitted into side surfaces of the optical semiconductor module 40*a*, 40*b* or 40*c*, particularly, into the connection grooves 422, so that the slit pieces 20*a*, 20*b*, 20*c* are assembled to the optical semiconductor modules 40*a*, 40*b*, 40*c*.

Among the three optical semiconductor modules 40*a*, 40*b*, 40*c*, a first optical semiconductor module 40*a* is placed at an upper portion of the circumference of the light-transmitting tube 20 and emits light downwards. Assuming that the optical semiconductor-based tube type lighting apparatus 1 according to this embodiment is horizontally mounted on the ceiling, the semiconductor optical devices 46*a* of the first optical semiconductor module 40*a* are placed near the uppermost end of the circumference of the light-transmitting tube 20 and act as light sources for illuminating an indoor space beneath the lighting apparatus. Herein, the uppermost end of the circumference refers to a position nearest to the ceiling.

Since the optical semiconductor modules 40*a*, 40*b*, 40*c* are arranged at equal intervals of 120 degrees, the first optical semiconductor module 40*a* does not face any other optical semiconductor module at an opposite side thereof. Although the semiconductor optical devices 46*a* of the first optical semiconductor module 40*a* emit light at an orientation angle in the range of about 120 to 150 degrees, a region directly beneath the first optical semiconductor module 40*a* has a higher light distribution amount than other regions, and thus there is substantially no light loss due to interference with light from the other optical semiconductor modules 40*b*, 40*c*.

Among the three optical semiconductor modules 40*a*, 40*b*, 40*c*, second and third optical semiconductor modules 40*b*, 40*c* are placed at opposite sides of a lower portion of the circumference of the light-transmitting tube 20 and emit light towards upper sides opposite thereto. Light emitted from the optical semiconductor devices 46*b*, 46*c* of the second and third optical semiconductor modules 40*b*, 40*c* covers regions that are not covered by light emitted from the first optical semiconductor module 40*a*, that is, rear and lateral regions of the lighting apparatus.

As the optical semiconductor modules 40*a*, 40*b*, 40*c* are arranged at constant intervals of 120 degrees, the second optical semiconductor module 40*b* does not face any other optical semiconductor module at an opposite side thereof, and the third optical semiconductor module 40*c* does not face any other optical semiconductor module at an opposite side thereof. Thus, light emitted from the semiconductor optical devices 46*b*, 46*c* of the second and third optical semiconductor modules 40*b*, 40*c* may illuminate the upper portion (or the rear side) of the lighting apparatus without substantially interfering with light from the other optical semiconductor modules. When the lighting apparatus is mounted on the ceiling, the second and third optical semiconductor modules 40*b*, 40*c* illuminate regions near the ceiling.

As such, the first, second and third optical semiconductor modules 40*a*, 40*b*, 40*c* are arranged at equal intervals along the circumference of the light-transmitting tube 20, so that light is uniformly distributed throughout the overall region of the light-transmitting tube 20, that is, over a region of 360 degrees, thereby providing uniform light distribution characteristics. Advantageously, power applied to the second and third optical semiconductor modules 40*b*, 40*c* may be lower than power applied to the first optical semiconductor module 40*a* to provide a lower light output at the rear side of the light-transmitting tube. To this end, the second and third optical semiconductor modules 40*b*, 40*c* may employ semiconductor optical devices having lower power consumption or may include a smaller number of semiconductor optical devices than the first optical semiconductor module. Here, application power and light output of the second optical semiconductor module 40*b* may be the same as those of the third optical semiconductor module 40*c*.

The semiconductor optical devices 46*a* of the first optical semiconductor module 40*a* may be configured to emit light having a desired color temperature, for example, about 5000K, and the second and third optical semiconductor modules 40*b*, 40*c* may include at least one semiconductor optical device 46*b* or 46*c*, which emits light having a different color temperature from that of the light emitted from the semiconductor optical device 46*a* of the first optical semiconductor module 40*a*, so that the lighting apparatus may act as a light source in the form of an indirect lamp having a color dimming function.

The optical semiconductor-based tube type lighting apparatus 1 according to this embodiment includes a light spreading layer 21 formed on an inner periphery of the light-transmitting tube 20. The light-transmitting tube 20 may be formed by coating a light spreading material on the inner periphery of the light-transmitting tube 20 or attaching a light spreading sheet thereto. The light spreading layer 21 widely spreads light passing through the light-transmitting tube 20, thereby preventing a surrounding region of the optical semiconductor modules 40*a*, 40*b*, 40*c* from becoming relatively dark. Alternatively, the light spreading layer may be formed on the outer periphery of the light-transmitting tube 20, or a light spreading material may be contained in a light-transmitting plastic material constituting the light-transmitting tube 20. Further, the light-transmitting tube 20 may include a wavelength converting material, preferably, remote phosphors. The remote phosphors may be formed on the inner periphery and/or outer periphery of the light-transmitting tube 20, and may be contained in a resin for the light-transmitting tube 20.

Figure 4:
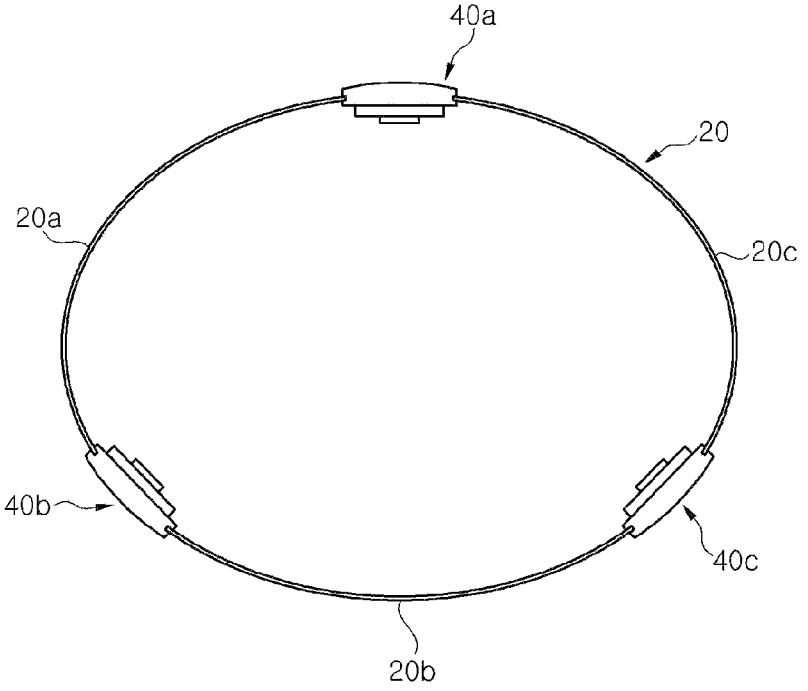
FIG. 4 is a cross-sectional view of an optical semiconductor-based tube type lighting apparatuses in accordance with another exemplary embodiment of the invention.
Figure 5:
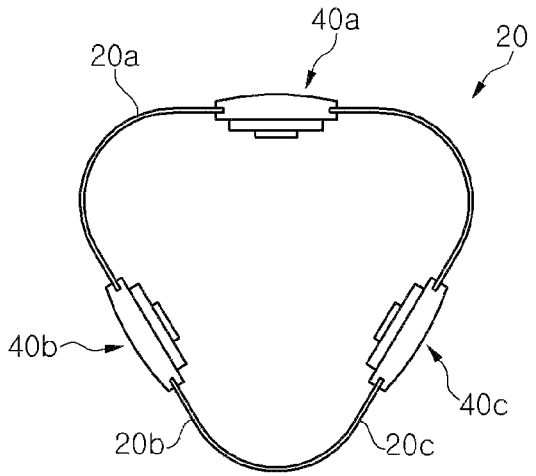
FIG. 5 is a cross-sectional view of an optical semiconductor-based tube type lighting apparatuses in accordance with a further exemplary embodiment of the invention.

FIG. 4 and FIG. 5 illustrates various exemplary embodiments of the invention.

In the optical semiconductor-based tube type lighting apparatus of FIG. 4, three optical semiconductor modules, that is, a first optical semiconductor module 40*a*, a second optical semiconductor module 40*b* and a third optical semiconductor module 40*c*, are arranged at intervals of about 120 degrees along the circumference of a substantially oval light-transmitting tube 20. The first, second and third optical semiconductor modules 40*a*, 40*b*, 40*c* are placed at three vertices of an isosceles triangle. As in the embodiment described above, the first optical semiconductor module 40*a* illuminates a region beneath the lighting apparatus, that is, a lower indoor space, and the second and third optical semiconductor modules 40*b*, 40*c* illuminate a region above the lighting apparatus, that is, a rear region near the ceiling.

In the optical semiconductor-based tube type lighting apparatus of FIG. 5, three optical semiconductor modules, that is, a first optical semiconductor module 40*a*, a second optical semiconductor module 40*b* and a third optical semiconductor module 40*c*, are arranged at intervals of about 120 degrees along the circumference of a light-transmitting tube 20 having a cross-section of a substantially equilateral triangle, which has a rounded surface near each vertex. The first optical semiconductor module 40*a* is placed on a horizontal upper side of the light-transmitting tube 20, and the second and third optical semiconductor modules 40*b*, 40*c* are placed on the remaining two side surfaces of the light-transmitting tube 20 in a cross-sectional view. The first optical semiconductor module 40*a* illuminates a region beneath the lighting apparatus, that is, a lower indoor space, and the second and third optical semiconductor modules 40*b*, 40*c* illuminate a region above the lighting apparatus, that is, a rear region near the ceiling. When a vertex or a sharp tip is present at a portion requiring much distribution of light, light loss can occur at such a portion. Thus, such a portion may have a rounded surface to prevent light loss as described above. As such, the light-transmitting tube 20 may be formed to exclude a vertex, sharp tip or other sharp shapes at a portion requiring much distribution of light.

Next, a tube type optical semiconductor-based lighting apparatus according to another exemplary embodiment of the invention and a method of manufacturing the same will be described. In the description of the embodiment, repeated description of like components will be omitted.

Figure 6:
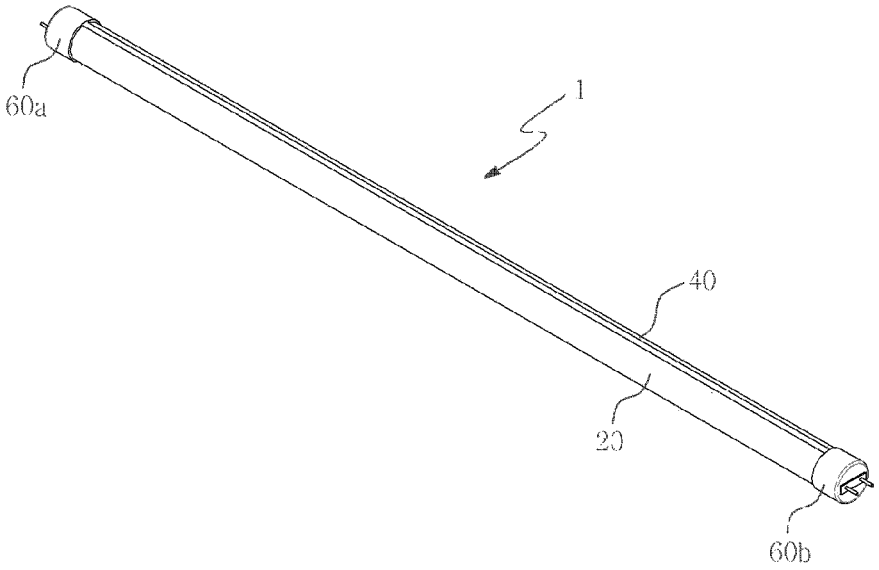
FIG. 6 is a perspective view of an optical semiconductor-based tube type lighting apparatuses in accordance with yet another exemplary embodiment of the invention.
Figure 7:
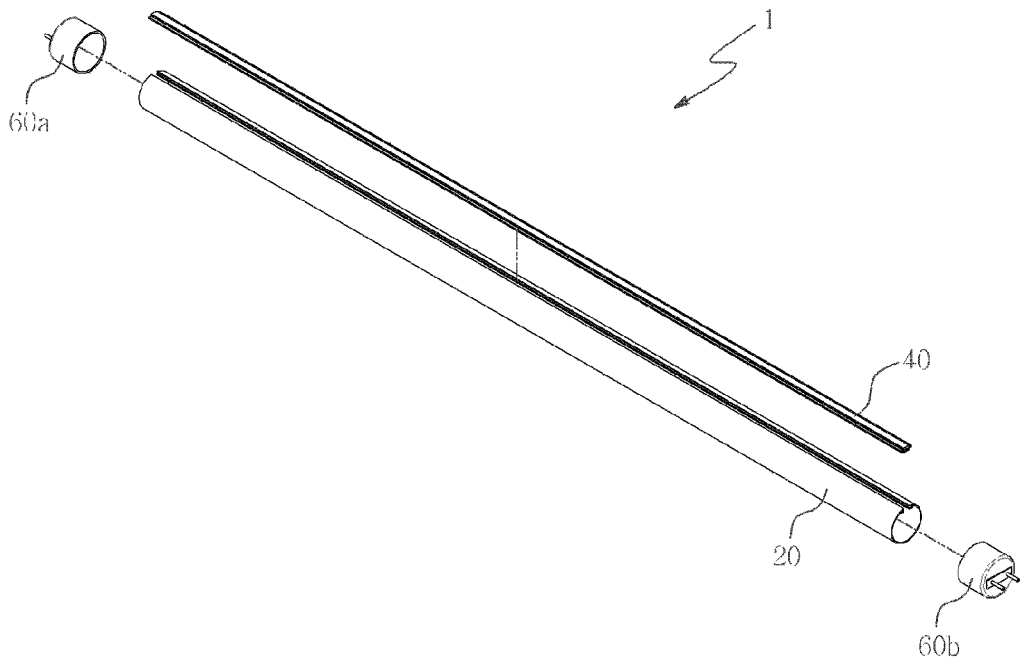
FIG. 7 is an exploded perspective view of the optical semiconductor-based tube type lighting apparatuses of FIG. 6.
Figure 8A:
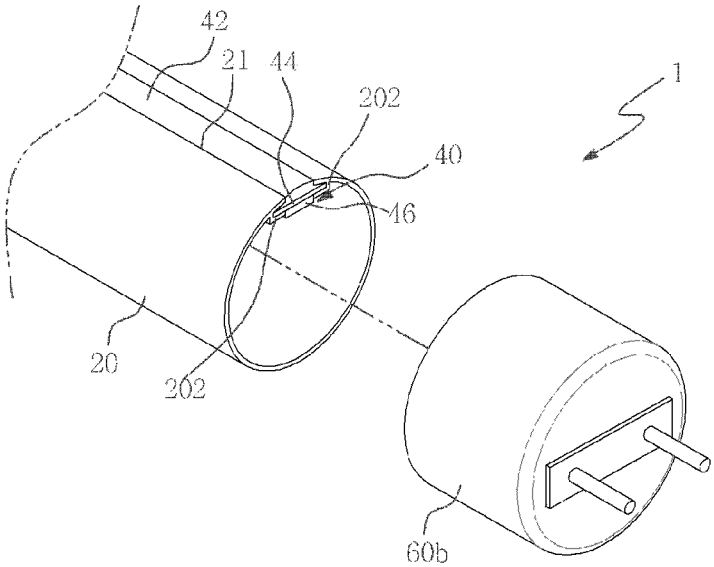
FIG. 8*a* is a partially enlarged perspective view of the semiconductor-based tube type lighting apparatus of FIG. 6.
Figure 8B:
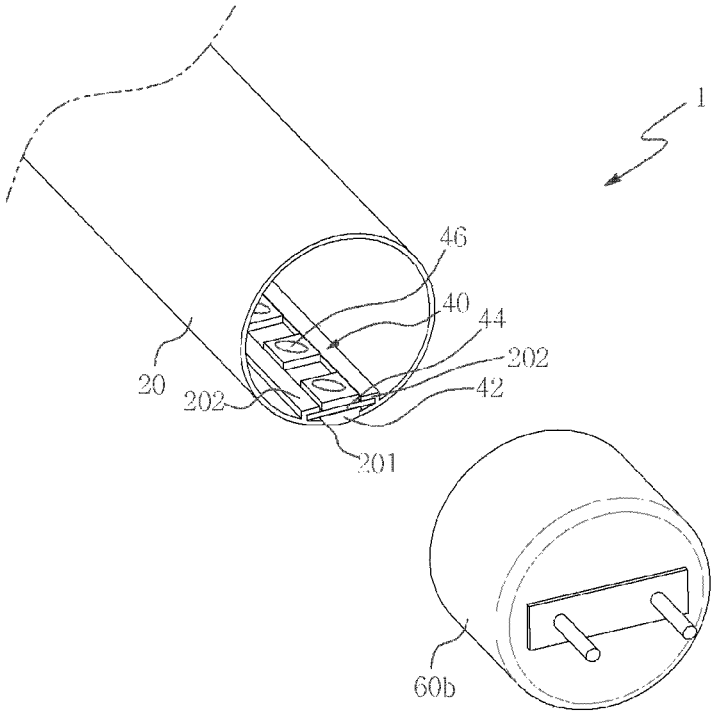
FIG. 8*b* is a partially enlarged perspective view of the semiconductor-based tube type lighting apparatus of FIG. 6.
Figure 9:
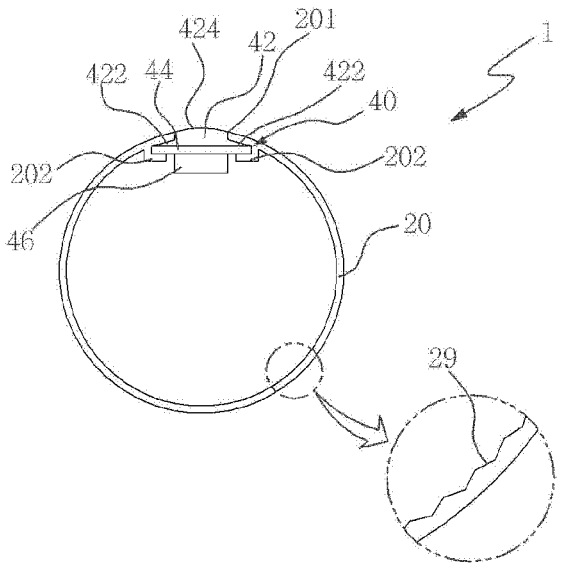
FIG. 9 is a cross-sectional view of the optical semiconductor-based tube type lighting apparatus of FIG. 6.

FIG. 6 is a perspective view of an optical semiconductor-based tube type lighting apparatus according to another exemplary embodiment of the invention, FIG. 7 is an exploded perspective view of the optical semiconductor-based tube type lighting apparatus of FIG. 6, FIGS. 8*a* and 8*b* are partially enlarged perspective views of the semiconductor-based tube type lighting apparatus according to the exemplary embodiment, from which a connector is separated, and FIG. 9 is a cross-sectional view of the optical semiconductor-based tube type lighting apparatus according to the exemplary embodiment. In the description of this exemplary embodiment, the same or like components to those of the above embodiment will be indicated by the same reference numerals as those of the above embodiment.

As shown in FIG. 6 to FIG. 9, the optical semiconductor-based tube type lighting apparatus 1 according to this embodiment includes an elongated hollow plastic light-transmitting tube 20 having a substantially circular cross-section, and a bar-shaped semiconductor module 40 disposed in a longitudinal direction of the light-transmitting tube 20.

In this embodiment, the light-transmitting tube 20 has an elongated mounting gap formed in the longitudinal direction thereof. The circumference of the light-transmitting tube is continuously formed except for the mounting gap. The substantially bar-shaped optical semiconductor module 40 is fitted into the mounting groove and is thus secured to a circular wall of the light-transmitting tube 20. Except for the region where the optical semiconductor module 40 is mounted, no optical semiconductor module 40 is present on the overall wall of the light-transmitting tube 20.

The light-transmitting tube 20 is provided at opposite ends thereof with two connectors 60*a*, 60*b*. Both of the connectors 60*a*, 60*b* serve as electrical connectors for supplying power to the optical semiconductor module 40. Alternatively, only one of the connectors 60*a*, 60*b*, for example, a connector 60*a*, may serve as an electrical connector for supplying power to the optical semiconductor module 40. In this case, the other connector 60*b* may serve only as a mechanical connector for connecting one end of the light-transmitting tube 20 to one end of the connector. Furthermore, both of the connectors 60*a*, 60*b* may serve as mechanical connectors instead of electrical connectors. In this case, a separate electrical connector, which does not provide a function of a mechanical connector, may be provided to the light-transmitting tube 20 through an opening of the light-transmitting tube 20 together with a cable.

As clearly shown in FIG. 8*b* and FIG. 9, the optical semiconductor module 40 includes an elongated heat sink 42, a PCB 44 attached to a flat front side of the heat sink 42, and an array of semiconductor optical devices 46 mounted on the PCB 44. The semiconductor optical devices mounted on the PCB 44 are longitudinally arranged in a single row to constitute an array of semiconductor optical devices. Here, the PCB 44 may be a metal-based MCPCB (Metal Core Printed Circuit Board) or MPCB (Metal Printed Circuit Board) having high thermal conductivity. The heat sink 42 is partially exposed from the light-transmitting tube 20 through the mounting gap.

As described in detail below, the optical semiconductor module 40 is longitudinally inserted into the mounting gap of the light-transmitting tube 20 in a sliding manner and is firmly coupled to the light-transmitting tube 20.

The light-transmitting tube 20 include a guide structure which allows sliding insertion of the optical semiconductor module 40 into the light-transmitting tube 20 along the mounting gap, and the heat sink 42 and the PCB 44 of the optical semiconductor module 40 have shapes to be slid into the light-transmitting tube 20 through the guide structure in a state of being coupled to each other.

The mounting gap and the guide structure of the light-transmitting tube 20 will be described in more detail hereinafter.

The light-transmitting tube 20 includes a linear slit 201 longitudinally formed to provide the mounting gap. As described in detail hereinafter, the slit 201 may be formed by longitudinally cutting the light-transmitting tube 20 with a laser or a sharp cutter such as a knife. The light-transmitting tube 20 is formed with a single guide structure, which includes a pair of hooks 202 facing each other and formed near the slit 201 on the inner periphery of the light-transmitting tube 20 in the longitudinal direction thereof, such that the optical semiconductor module 40 is guided by the hooks 202 in a sliding manner.

As described below, the hooks 202 may be integrally formed with the light-transmitting tube 20 when forming the light-transmitting tube 20. Further, the slit 201 is formed by longitudinally cutting the light-transmitting tube 20 having the hooks 202. Here, since the slit 201 is placed between the pair of hooks 202, the pair of hooks 202 may be widened by forcibly widening the slit 201.

As clearly shown in FIG. 9, the heat sink 42 has the flat front surface to which the PCB 44 is attached. Further, the heat sink 42 includes a pair of guide wings 422 formed at the right and left of a rear side thereof, and a heat dissipation protrusion 424 at the center of the rear side. Each of the guide wings 422 has a flat front surface and a curved rear surface, which is identical or similar to the inner periphery of the light-transmitting tube 20. The heat dissipation protrusion 424 extends along the center of the rear side of the heat sink 42 in the longitudinal direction and has vertical surfaces at opposite sides thereof. The heat dissipation protrusion 424 has a curved rear surface, which is identical or similar to the outer periphery of the light-transmitting tube 20.

The PCB 44 has right and left edges with respect to the center thereof on which the semiconductor optical devices 46 are arranged. The right and left edges of the PCB 44 protrude together with the guide wings 422 of the heat sink 42 from opposite sides of the optical semiconductor module 40. The PCB 44 may have a greater width than the front side of the heat sink 42, so that right and left edges of the PCB 44 are located farthest from the right and left of the optical semiconductor module 40.

When the optical semiconductor module 40 is fitted into the mounting gap of the light-transmitting tube 20 in a sliding manner, the left guide wing 422 of the heat sink 42 and the left edge of the PCB 44 are inserted together into the left hook 202, and the right guide wing 422 of the heat sink 42 and the right edge of the PCB 44 are inserted together into the right hook 202 in the longitudinal direction. That is, each of the hooks 202 holds the edges of the heat sink 42 and the PCB 44 at the same time. In addition, since the pair of hooks 202 has the guide structure, the optical semiconductor module 40 may be inserted into the pair of hooks 202 in a sliding manner.

Since the insertion of the optical semiconductor module 40 in the longitudinal direction is carried out after forcibly widening the slit 201 of the light-transmitting tube 20, the slit 210 is elastically deformed to be narrowed after insertion of the optical semiconductor module 40, so that the optical semiconductor module 40 may be firmly secured to the mounting gap.

When the portions of the optical semiconductor module 40 inserted into the respective hooks 202 are respectively referred to as left and right protrusions of the optical semiconductor module 40, each of the left and right protrusions includes the guide wing 422 of the heat sink 42 and the edge of the PCB 44 on the guide wing. A rear protrusion of the optical semiconductor module 20, that is, the heat dissipation protrusion 424 at the rear side of the heat sink 42, is exposed from the light-transmitting tube 20 through the widened slit 201 of the light-transmitting tube 20. Right and left edges of the slit 201, that is, right and left cut surfaces, are inserted into the side surfaces of the optical semiconductor module to contact side surfaces of the heat dissipation protrusion 424. At this time, the edges of the slit 201, that is, the cut surfaces, forcibly compress both sides of the protrusion 424 by elasticity narrowing the slit 201.

As clearly shown in FIG. 9, an undulating light spreading pattern 29 for spreading light is formed on the inner periphery of the light-transmitting tube 20. The light spreading pattern 29 may be formed on the inner periphery of the light-transmitting tube 20 when forming the light-transmitting tube 20 by, for example, injection molding.

Next, a method of manufacturing the optical semiconductor-based tube type lighting apparatus as described above according to one exemplary embodiment will be described with reference to FIG. 10 and FIG. 11.

Figure 10:
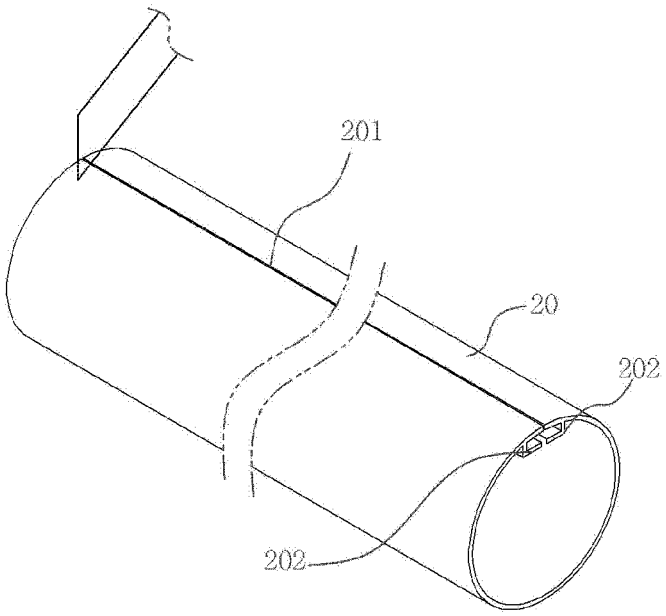
FIG. 10 is a perspective view of an optical semiconductor-based tube type lighting apparatuses in accordance with yet another exemplary embodiment of the invention.

Referring to FIG. 10, a light-transmitting tube 20 is prepared by, for example, injection molding. Here, the light-transmitting tube 20 has a pair of hooks 202 elongated in the longitudinal direction of the light-transmitting tube 20 and facing each other. Then, an elongated linear slit 201 is formed over the entire length of the light-transmitting tube 20 at the middle between the pair of hooks 202. The slit 201 is formed by longitudinally cutting the light-transmitting tube 20 with a laser or a sharp cutter such as a knife. As the slit 201 is formed, the light-transmitting tube 20 is formed with a mounting gap, which is placed between the pair of hooks 202 and is capable of being widened by external force.

Figure 11:
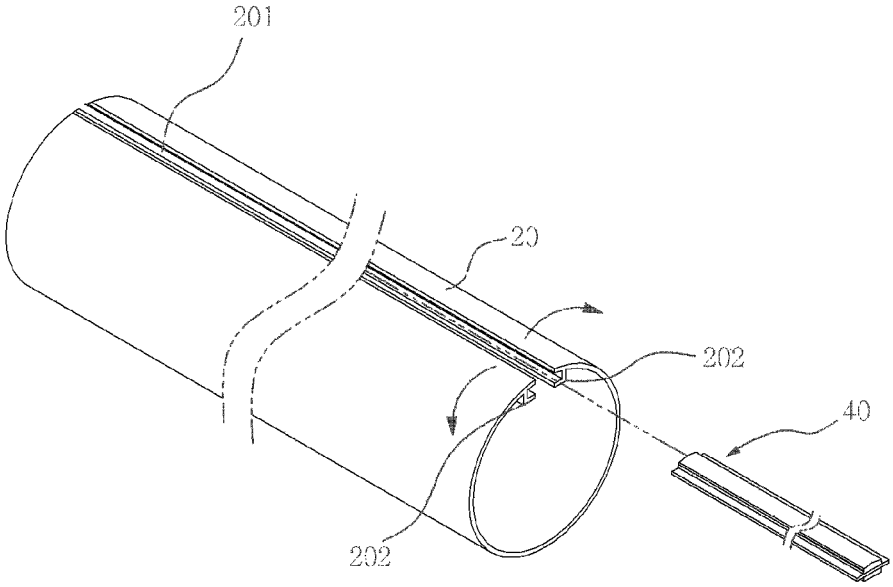
FIG. 11 is a perspective view of the optical semiconductor-based tube type lighting apparatuses of FIG. 10.

Then, referring to FIG. 11, the width of slit 201 is widened by applying force to the light-transmitting tube 20 in a direction of an arrow. Next, the linear optical semiconductor module 40 is inserted in a sliding manner into the mounting gap formed by widening the slit 201. At this time, right and left protrusions of the linear optical semiconductor module 40 are respectively inserted into and guided by the pair of hooks 202, and a rear protrusion of the optical semiconductor module 40 is inserted into and guided by the widened slit 201 in a sliding manner. As described above, each of the protrusions of the optical semiconductor module 40 respectively inserted into the pair of hooks 202 includes the right or left edge of the PCB and the right or left guide wing of the heat sink.

Then, one end or both ends of the light-transmitting tube 20 are finished with a connector, thereby completing the optical semiconductor-based tube type lighting apparatus.

Next, a method of manufacturing the optical semiconductor-based tube type lighting apparatus as described above according to another exemplary embodiment will be described with reference to FIG. 12 to FIG. 14.

As in the embodiment described above, a light-transmitting tube 20 having a pair of hooks 202 formed on an inner periphery thereof is prepared. As in the embodiment described above, an elongated linear slit 201 is formed over the entire length of the light-transmitting tube 20, except for a portion of the light-transmitting tube 20 near one end thereof, at the middle between the pair of hooks 202. In this embodiment, the slit 201 is formed by longitudinally cutting the light-transmitting tube 20 with a laser or a sharp cutter such as a knife.

Figure 12:
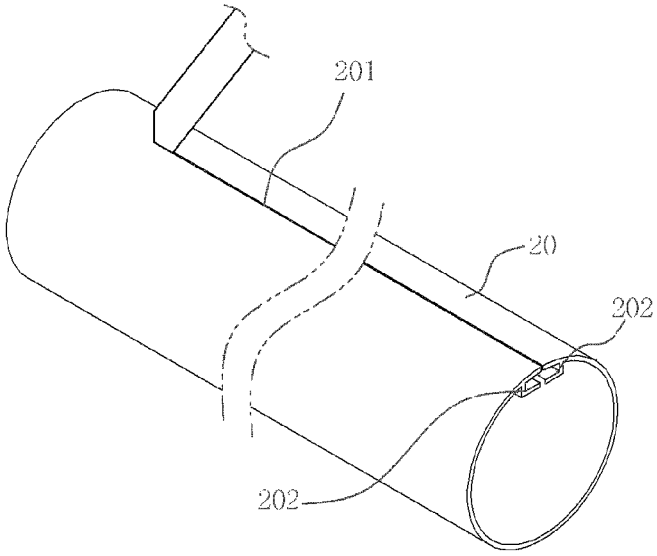
FIG. 12 is a perspective view of an optical semiconductor-based tube type lighting apparatuses in accordance with yet another exemplary embodiment of the invention.

Then, referring to FIG. 12, the width of slit 201 is widened by applying force to the light-transmitting tube 20 in a direction of an arrow, except for a portion near one end of the light-transmitting tube in which a slit is not formed. Next, as in the embodiment described above, the linear optical semiconductor module 40 is inserted in a sliding manner into the mounting gap formed by widening the slit 201.

Figure 13:
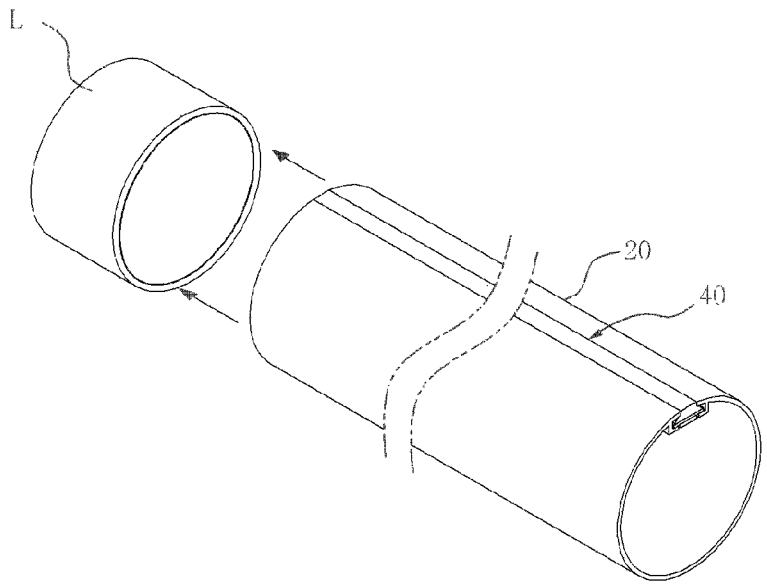
FIG. 13 is a perspective view of the optical semiconductor-based tube type lighting apparatuses of FIG. 12.

Then, referring to FIG. 13, the portion L of the light-transmitting tube 20 in which the slit 201 is not formed is cut and removed from the light-transmitting tube 20. As a result, the slit 201 is formed over the entire length of the light-transmitting tube 20. After removing the portion of the light-transmitting tube 20, the optical semiconductor module 40 is further pushed into the mounting gap in the case where the optical semiconductor module 40 is not sufficiently inserted into the mounting gap. The method according to this embodiment has various advantages. Particularly, this method may provides process convenience obtained by widening one side of the slit 201 of the elongated light-transmitting tube 20, and a lighting apparatus, for example, like the lighting apparatus according to the embodiment shown in FIG. 1 to FIG. 5, by forming a plurality of slits in the light-transmitting tube 20 and mounting a plurality of optical semiconductor modules to the plurality of slits.

In the exemplary embodiments described above, a single optical semiconductor module 40 is illustrated as being inserted into a single mounting gap or a single slit 201 of the light-transmitting tube 20. However, it may be contemplated that two or more optical semiconductor modules 40 may be inserted together into a single mounting gap or a single slit 201 in an optical semiconductor-based tube type lighting apparatus according to another exemplary embodiment, as shown in FIG. 14.

Figure 14:
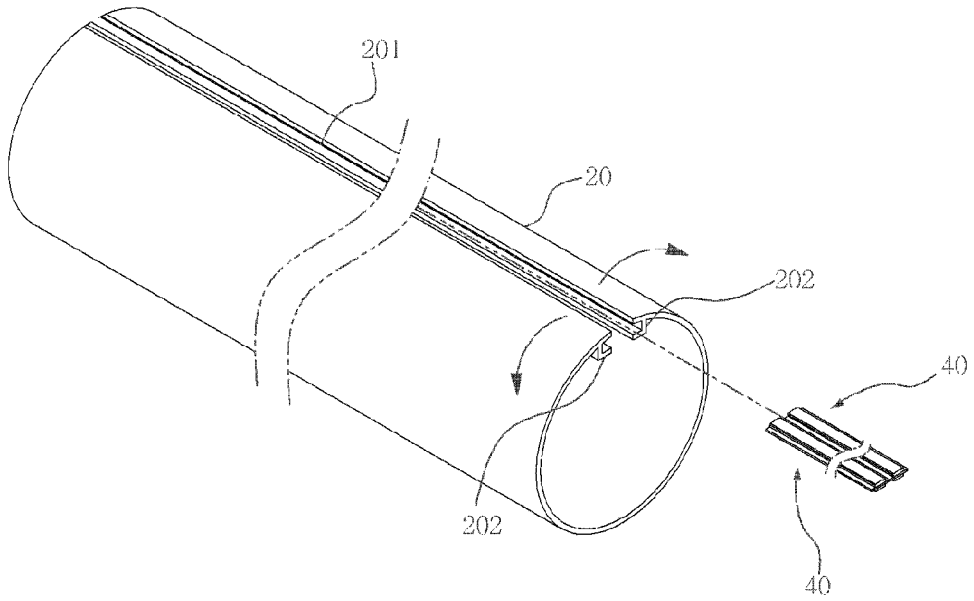
FIG. 14 is a perspective view of the optical semiconductor-based tube type lighting apparatus of FIG. 12.

Referring to FIG. 14, with adjacent side surfaces of the two optical semiconductor modules 40 coupled to each other, the two optical semiconductor modules 40 are inserted into a single slit 201 of a light-transmitting tube 20. At this time, protrusions on side surfaces of the two semiconductor modules 40, which are not adjacent each other, may be respectively inserted into a pair of hooks 202 of the light-transmitting tube 20 in a sliding manner. The structure wherein the adjacent side surfaces of the two optical semiconductor modules are coupled to each other may be modified in various ways, and thus a detailed description thereof will be omitted herein. Further, the two optical semiconductor modules 40 inserted into a single slit may be collinearly connected to each other or may be connected to each other to cross at a predetermined angle.

As such, according to embodiments of the invention, the optical semiconductor-based tube type lighting apparatus includes a first optical semiconductor module emitting light towards a lower front side of a light-transmitting tube, and second and third optical semiconductor modules emitting light towards an upper rear side of the light-transmitting tube. Thus, the optical semiconductor-based tube type lighting apparatus according to the exemplary embodiments does not suffer from a problem of conventional tube type or fluorescent lamp type LED lighting apparatuses in which the upper rear region of the light-transmitting tube is relatively dark.

According to the exemplary embodiment, in the optical semiconductor-based tube type lighting apparatus, some of the optical semiconductor modules are configured to have different color temperatures, so that the optical semiconductor-based tube type lighting apparatus may be used as an indirect lamp. As such, the optical semiconductor-based tube type lighting apparatus according to the exemplary embodiments may be suited not only to general indoor lighting, but also to outdoor lighting.

According to the exemplary embodiments, in the tube type optical semiconductor-based lighting apparatus, the bar-shaped optical semiconductor modules are directly mounted on the wall of the light-transmitting tube to increase the distance between the semiconductor optical devices and the light-transmitting tube, thereby increasing light distribution. Further, according to the exemplary embodiments, when mounting the bar-shaped optical semiconductor module directly on the wall of the light-transmitting tube such that the semiconductor module is partially exposed from the light-transmitting tube, the slit formed on the light-transmitting tube is widened to allow the optical semiconductor module to be easily inserted into the widened slit in a sliding manner, thereby significantly improving assembly properties of the optical semiconductor-based tube type lighting apparatus.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. An optical semiconductor-based lighting apparatus comprising:

an elongated light-transmitting tube having a hollow circular cross-section; and a plurality of optical semiconductor modules arranged along a circumference of the light-transmitting tube and separated from each other in a cross-sectional view of the light-transmitting tube, each of the optical semiconductor modules being placed on a point, which is not on a central axis line of light emitted from other optical semiconductor modules, so as not to face the other optical semiconductor modules, the plurality of optical semiconductor modules comprising a first optical semiconductor module placed at an upper portion of a cross-sectional view of the light-transmitting tube, such that an angle defined between a tangential line to the light-transmitting tube and the central axis line of light becomes 90 degrees, and emitting light downwards beneath the light-transmitting tube, and second and third optical semiconductor modules slantly placed at opposite lower sides of the light-transmitting tube so as not to face the first optical semiconductor module and emitting light upwards, wherein the light-transmitting tube comprises at least three slit pieces separated from one another, and each of the optical semiconductor modules is assembled to a mounting gap between adjacent slit pieces, wherein each of the optical semiconductor modules comprises a base exposed through the mounting gap, a PCB coupled to the base and placed within the light-transmitting tube, and an array of semiconductor optical devices mounted on the PCB, and wherein the base is formed at opposite sides thereof with connection grooves corresponding to edges of each of the slit pieces such that the edges of each of the slit pieces are respectively fitted into the connection grooves.

2. The optical semiconductor-based lighting apparatus of claim 1, wherein the plural optical semiconductor modules are arranged at equal intervals.

3. The optical semiconductor-based lighting apparatus of claim 1, wherein the first, second and third optical semiconductor modules are placed at three vertices of an isosceles or equilateral triangle, respectively.

4. The optical semiconductor-based lighting apparatus of claim 1, wherein each of the optical semiconductor modules comprises an array of semiconductor optical devices arranged in a longitudinal direction of the light-transmitting tube.

5. The optical semiconductor-based lighting apparatus of claim 1, wherein the light-transmitting tube comprises a light spreading material on a surface thereof or therein.

6. The optical semiconductor-based lighting apparatus of claim 1, wherein the light-transmitting tube comprises a wavelength converting material on a surface thereof or therein.

7. The optical semiconductor-based lighting apparatus of claim 1, wherein the first optical semiconductor module has a light output, which is higher than those of the second and third optical semiconductor modules and those of the second and third optical semiconductor modules are the same.

8. The optical semiconductor-based lighting apparatus of claim 1, wherein the second and third optical semiconductor modules have different color temperatures from the color temperature of the first optical semiconductor module.

9. The optical semiconductor-based lighting apparatus of claim 1, wherein when the lighting apparatus is mounted on a ceiling, the first optical semiconductor module is placed on a region of the light-transmitting tube nearer to the ceiling than any other region thereof.

10. The optical semiconductor-based lighting apparatus of claim 1, wherein the plurality of optical semiconductor modules are three optical semiconductor modules arranged at equal intervals of 120 degrees.

11. The optical semiconductor-based lighting apparatus of claim 5, wherein the light-transmitting tube comprises three slit pieces having an arcuate cross-section and separated from each other, and each of the three optical semiconductor modules is assembled to a mounting gap between adjacent slit pieces.

12. The optical semiconductor-based lighting apparatus of claim 1, further comprising: a pair of connectors disposed at opposite ends of the light-transmitting tube, at least one of the pair of the connectors being a dummy connector which does not act as an electrical connector.

13. The optical semiconductor-based lighting apparatus of claim 1, wherein the optical semiconductor modules are mounted at an equal angle as defined between the tangential line to the light-transmitting tube and the central axis line of light.

* * * * *